US008267670B2

(12) United States Patent
Adler et al.

(10) Patent No.: US 8,267,670 B2
(45) Date of Patent: Sep. 18, 2012

(54) PISTONLESS COMPRESSOR

(75) Inventors: Robert Adler, Gerasdorf (AT); Helmut Mayer, Rust im Tullnerfeld (AT)

(73) Assignee: Linde Aktiengesellschaft, Munich (DE)

( * ) Notice: Subject to any disclaimer, the term of this patent is extended or adjusted under 35 U.S.C. 154(b) by 629 days.

(21) Appl. No.: 12/440,608

(22) PCT Filed: Sep. 6, 2007

(86) PCT No.: PCT/EP2007/007772

§ 371 (c)(1),
(2), (4) Date: Oct. 21, 2009

(87) PCT Pub. No.: WO2008/031527

PCT Pub. Date: Mar. 20, 2008

(65) Prior Publication Data

US 2010/0034671 A1 Feb. 11, 2010

(30) Foreign Application Priority Data

Sep. 13, 2006 (DE) ..... 10 2006 042 918

(51) Int. Cl.
*F04B 23/10* (2006.01)

(52) U.S. Cl. ..... 417/85

(58) Field of Classification Search ..... 417/101–103, 417/378, 65, 85, 211.5, 240, 377
See application file for complete search history.

(56) References Cited

U.S. PATENT DOCUMENTS

| | | | | |
|---|---|---|---|---|
| 4,566,860 | A * | 1/1986 | Cowan | 417/102 |
| 5,073,090 | A * | 12/1991 | Cassidy | 417/102 |
| 6,652,243 | B2 * | 11/2003 | Krasnov | 417/102 |
| 2003/0039554 | A1 | 2/2003 | Krasnov | |

FOREIGN PATENT DOCUMENTS

| | | | |
|---|---|---|---|
| GB | 09591 | A | 0/1911 |
| JP | 56 092381 | A | 7/1981 |
| WO | WO 2006/034748 | | 4/2006 |

* cited by examiner

*Primary Examiner* — Devon Kramer
*Assistant Examiner* — Bryan Lettman
(74) *Attorney, Agent, or Firm* — Philip H. Von Neida

(57) ABSTRACT

A compressor for the compressing of gaseous medium with at least one compressor cylinder which is connected with an inlet duct and with an outlet duct for the medium, an operating fluid, in particular an ionic operating fluid, being arranged in the compressor cylinder, which fluid is connected with a displacement machine, the displacement machine being constructed as a piston machine with at least one cylinder chamber and each cylinder chamber being connected with a compressor cylinder. To solve the problem of providing a compressor which guarantees a reliable operation with low structural expenditure, it is proposed that a separation device for the operating fluid is associated with the outlet duct of the compressor, the separation device being connected with the inlet duct of the compressor for the return of the operating fluid.

7 Claims, 1 Drawing Sheet

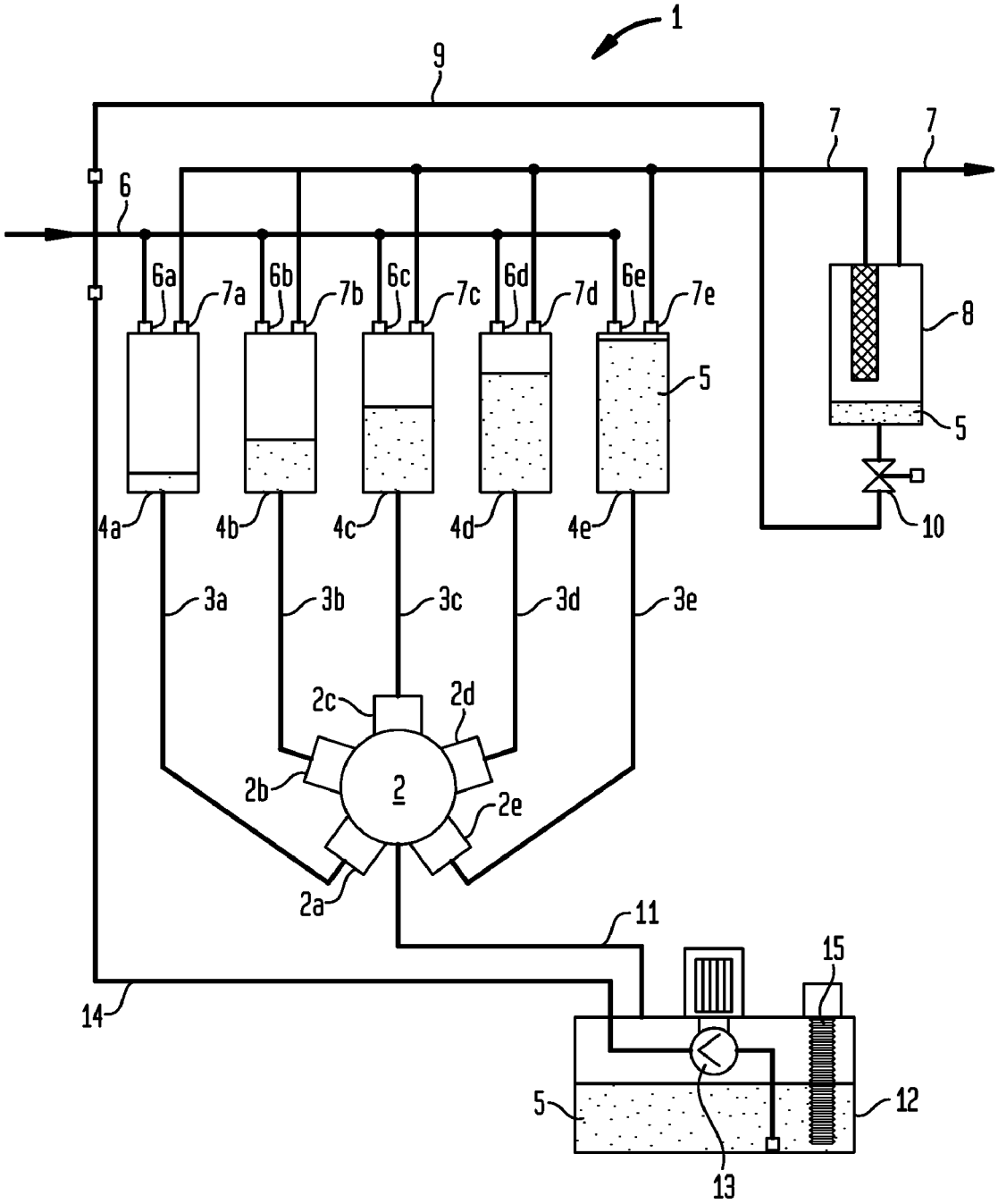
1
9
7
7
6
6a
7a
6b
7b
6c
7c
6d
7d
6e
7e
8
5
5
4a
4b
4c
4d
4e
10
3a
3b
3c
3d
3e
2c
2d
2b
2
2e
2a
11
15
14
5
12
13

PISTONLESS COMPRESSOR

CROSS-REFERENCE TO RELATED APPLICATION

This application claims priority under 35 USC §119 to International Patent Application No. PCT/EP2007/007772 filed in the European Patent Office on Sep. 6, 2007, which claims priority from German Patent Application DE 1020060429 filed Sep. 13, 2006.

BACKGROUND OF THE INVENTION

The invention relates to a compressor for the compression of gaseous medium with at least one compressor cylinder, which is connected with an inlet duct and an outlet duct for the medium, with an operating fluid, in particular an ionic operating fluid, being arranged in the compressor cylinder, which fluid is connected with a displacement machine, in which the displacement machine is constructed as a piston machine with at least one cylinder chamber and each cylinder chamber is connected with a compressor cylinder.

SUMMARY OF THE INVENTION

Such compressors are used for the compressing of gaseous media, for example natural gas or hydrogen. The medium is displaced here by means of the operating fluid in the compressor cylinder, whereby such compressors are designated as pistonless compressors. An ionic fluid can be used as the fluid. However, it is likewise possible to use fluids with a low vapour pressure or fluids with a low gas solubility. Such fluids have in common the fact that they do not dissolve in the medium and are able to be separated from the medium without residue, so that the compressed medium has a high degree of purity.

A pistonless compressor for gaseous media is known from U.S. Pat. No. 6,652,243 B2. In this pistonless compressor, the operating fluid in the compressor cylinders is connected with a displacement machine, constructed as a hydraulic pump, a control valve being provided to control the inflow and outflow of the operating fluid, said control valve being controlled as a function of the fluid level of the operating fluid in the compressor cylinders which is detected by means of electronic travel measurement systems. The compressor cylinders are preferably arranged vertically, in order to assist the outflow of operating fluid out of the displacement cylinder through gravity. In such a compressor, the fluid column of the operating fluid can not be accelerated by gravitational acceleration, so that the cycle speed of the compressor is limited by gravitational acceleration. Due to this high cycle time and long station times, such compressors have a high delivery flow pulsation of the delivery flow of the compressed medium. Where a uniform delivery flow of compressed medium is necessary, for example for the refuelling of vehicles, an intermediate reservoir is necessary, into which the compressor cylinders convey. To achieve a high compressor performance, large cylinder dimensions of the compressor cylinders are necessary owing to the high cycle time. The large cylinder dimensions and the intermediate reservoir bring about high manufacturing costs and the requirement of a large amount of space. In addition, through the electronic travel measurement systems and the control valve, a high structural expenditure is also brought about. Furthermore, through the large cylinder dimensions, a large quantity of operating fluid is necessary, which brings about high manufacturing costs and high operating costs. To drive the large quantity of operating fluid, a powerful hydraulic pump is necessary, which has correspondingly high manufacturing costs and has a high noise level in operation.

From WO 2006/034748 A1 a pistonless compressor is known with an operating fluid formed as ionic fluid. A separation device is provided in order to regain from the outlet duct ionic fluid which is conveyed into the compressed medium. The ionic fluid is fed into the compressor cylinders by means of a feeding device. For this, a level measurement system is provided, by means of which the level of the operating fluid in the compressor cylinders is measured, and on falling below a reference value, operating fluid is fed into the compressor cylinder by means of the feeding device. In addition to the disadvantages already known from U.S. Pat. No. 6,652,243 B2, a compressor known from WO 20061034748 A1 has a high structural expenditure due to the level measurement system.

In addition, generic compressors are known, in which the displacement machine is constructed as a piston machine with at least one cylinder chamber and each cylinder chamber is connected with a compressor cylinder. Hereby, the delivery flow of compressed medium is produced by several compressor cylinders, which are respectively connected with a cylinder chamber of the piston machine and convey in succession and hence uniformly into the outlet duct, whereby a delivery flow of compressed medium with a low delivery flow pulsation is able to be achieved. Such generic compressors have short station times and hence a short cycle time, whereby the cylinder dimensions of the compressor cylinders can be reduced. Hereby, a small structural space requirement and a low manufacturing expenditure are the result. In addition, the quantity of operating fluid can be reduced, whereby likewise a low operating expenditure is the result. Additionally, it is possible furthermore to move the operating fluid with approximately gravitational acceleration, with the piston machine being able to be operated at a high rotation speed. Hereby, for a high compressor performance, the structural expenditure and the noise nuisance can be reduced for the displacement machine which is constructed as a piston machine. In such generic compressors, however, owing to the short cycle time in the compressor cylinders an exact level measurement of the operating fluid is no longer possible, whereby a secure operation of the compressor with a sufficient quantity of operating fluid in the displacement cylinders is no longer guaranteed.

The present invention is based on the problem of providing a compressor of the type mentioned in the introduction, in which a reliable operation is guaranteed with low structural expenditure.

This problem is solved according to the invention in that a separation device for the operating fluid is associated with the outlet duct of the compressor, the separation device being connected with the inlet duct of the compressor for the return of the operating fluid. According to the invention, the operating fluid conveyed by the compressor into the outlet duct is thereby separated from the compressed medium by means of the separation device and is conveyed back directly into the inlet duct. Hereby, it is possible in a simple manner to maintain a level of operating fluid in the compressor cylinders which is necessary for the reliable operation of the compressor, with no level measurement system being necessary on the compressor cylinders for the operation of the compressor. Hereby, a reliable operation of the compressor can be guaranteed with a low structural expenditure.

According to a preferred embodiment of the invention, the separation device is connected with the inlet duct by means of a return duct, with a valve device being arranged in the return duct. The valve device can be constructed for example as a nonreturn valve opening in the direction of the inlet duct. In addition, it is possible to construct the valve device as a switchable check valve. With such valve devices it is possible in a simple manner to convey continuously or cyclically into the inlet duct operating fluid which is separated from the outlet duct by means of the separation device, whereby in a simple manner the compressor is able to be operated with a constant quantity of operating fluid.

According to a preferred further development of the invention, a container is provided which is connected with the piston machine by means of a leakage duct. The leakage quantity of operating fluid occuring in operation of the piston machine can be supplied hereby in a simple manner to a container.

Particular advantages result when a feed pump is provided, which is connected on the input side with the container and on the output side with the inlet duct of the compressor. The leakage quantity of operating fluid of the piston machine situated in the container can be supplied hereby in a simple manner to the inlet side of the compressor, whereby the compressor is able to be operated with a constant quantity of operating fluid.

The feed pump can be operated here continuously or cyclically.

According to one development form of the invention, the feed pump is able to be controlled as a function of the quantity of operating fluid situated in the container. Hereby, it is possible in a simple manner to keep the quantity of operating fluid in the compressor constant, in order to achieve a reliable operation of the compressor.

Expediently, the container is provided here with a level measurement system, with the feed pump being able to be controlled as a function of the level measurement system. With a level measurement system detecting the quantity of operating fluid in the container, the quantity of operating fluid in the compressor cylinders can be kept constant with low structural expenditure.

According to an embodiment of the invention, the piston machine can be constructed as a radial piston machine. With a radial piston machine, with each cylinder chamber of the radial piston machine being connected with a compressor cylinder, a delivery flow of compressed medium with a low delivery flow pulsation can be achieved with a small structural expenditure and space requirement. In addition, radial piston machines have a long lifespan, whereby a long lifespan is able to be achieved for the compressor.

According to a further embodiment of the invention, the piston machine can likewise be constructed as an axial piston machine. With an axial piston machine, in which each cylinder chamber is connected with a compressor cylinder, likewise a delivery flow of compressed medium can be achieved with a low delivery flow pulsation with low structural expenditure and space requirement and a high lifespan of the compressor.

BRIEF DESCRIPTION OF THE DRAWING

The figure is a schematic of a compressor cylinder in accordance with the present invention.

Further advantages and details of the invention are explained in further detail with the aid of the example embodiment illustrated in the diagrammatic FIGURE.

DETAILED DESCRIPTION OF THE INVENTION

In the FIGURE, a circuit diagram is illustrated of a compressor 1 according to the invention. The compressor 1 has a displacement machine which is constructed as piston machine 2, for example a radial piston machine, which is provided with several cylinder chambers 2*a*, 2*b*, 2*c*, 2*d*, 2*e*. Each cylinder chamber 2*a*, 2*b*, 2*c*, 2*d*, 2*e*, in which respectively a piston, which is no longer illustrated, is displaceably mounted, is connected by means of a connection duct 3*a*, 3*b*, 3*c*, 3*d*, 3*e* with a compressor cylinder 4*a*, 4*b*, 4*c*, 4*d*, 4*e*. Operating fluid 5, formed as ionic fluid, which is movable by means of the piston machine 2, is situated in the compressor cylinders 4*a*, 4*b*, 4*c*, 4*d*, 4*e*.

The compressor cylinders 4*a*, 4*b*, 4*c*, 4*d*, 4*e* are connected on the input side via respectively an inlet valve 6*a*, 6*b*, 6*c*, 6*d*, 6*e* with an inlet duct 6 for medium which is to be compressed, for example natural gas or hydrogen. To increase the input pressure and hence the output performance, a pre-compressor can be associated with the inlet duct 6. At the output side, the compressor cylinders 4*a*, 4*b*, 4*c*, 4*d*, 4*e* are connected to an outlet duct 7 via respectively an outlet valve 7*a*, 7*b*, 7*c*, 7*d*, 7*e*.

In the outlet duct 7, a separation device 8 is arranged, constructed for example as a fluid separator, by means of which operating fluid 5 which is conveyed by the compressor cylinders 4*a*, 4*b*, 4*c*, 4*d*, 4*e* into the outlet duct 7 can be separated.

According to the invention, the separation device 8 is connected with a return duct 9, which is connected to the inlet duct 6. In the return duct 9, a valve device 10 is arranged. By means of the return duct 9, operating fluid 5 which is separated from the outlet duct 7 by the separation device 8 can be conveyed back to the inlet duct 6. Hereby, it is possible in a simple manner to keep the quantity of operating fluid 5 in the compressor cylinders 4*a*, 4*b*, 4*c*, 4*d*, 4*e* constant.

The piston machine 2 is connected with a leakage duct 11, which is directed to a container 12. The leakage quantity of operating fluid 5 occurring in the operation of the piston machine 2 flows here via the leakage duct 11 to the container 12. The container 12 is provided with a level measurement system 15. By means of a feed pump 13, which is connected on the input side with the container 12 and is connected on the output side via a feed duct 14 with the inlet duct 6, the leakage quantity of operating fluid 5 of the piston machine 2 flowing via the leakage duct 11 into the container 12 can be conveyed to the inlet duct 6. The feed pump 13 can be operated here as a function of the level measurement system 15. Hereby it is possible in a simple manner to keep the quantity of operating fluid 5 in the compressor cylinders 4*a*, 4*b*, 4*c*, 4*d*, 4*e* constant.

In the operation of the compressor 1, the operating fluid situated in the compressor cylinders 4*a*, 4*b*, 4*c*, 4*d*, 4*e* is moved by the piston machine 2 with almost gravitational acceleration such that medium which is to be compressed in the compressor cylinders 4*a*, 4*b*, 4*c*, 4*d*, 4*e* is sucked in out of the inlet duct 6 and compressed medium is conveyed into the outlet duct 7. The compressor cylinders 4*a*, 4*b*, 4*c*, 4*d*, 4*e* convey here with a low station time and hence with a high cycle speed in succession into the outlet duct 7, whereby a delivery flow of compressed medium with a low delivery flow pulsation is achieved. The quantity of operating fluid 5 in the compressor cylinders 4*a*, 4*b*, 4*c*, 4*d*, 4*e* is measured here such that a conveying of operating fluid 5 into the outlet duct 7 occurs continuously. Hereby, it is achieved that medium which is sucked in out of the inlet duct 6 is fully compressed and conveyed into the outlet duct 7, whereby dead volume and hence conveying losses of the medium which is to be compressed are reduced.

The operating fluid 5 which is conveyed here by the compressor 1 into the outlet duct 7 is separated from the compressed medium by means of the separation device 8. The separated quantity of operating fluid 5 can be conveyed back to the inlet duct 6 continuously or cyclically here via the return duct 9 and the valve device 10, and thereby the quantity of operating fluid in the compressor cylinders 4*a*, 4*b*, 4*c*, 4*d* can be kept constant.

The operating fluid 5 occurring as leakage quantity in the operation of the piston machine 2 flows via the leakage duct 11 into the container 12. By means of the level measurement system 15, the leakage quantity of operating fluid 5 which occurs is measured in the container 12 and the feed pump 13, frequency-regulated for example, is controlled according to the measured leakage quantity of operating fluid 5 in the container 12, whereby operating fluid 3 occurring as leakage of the piston machine 2 is conveyed out of the container 12 to the inlet duct 6. Hereby, it is ensured that a constant quantity of operating fluid 5 is present in the compressor cylinders 4*a*, 4*b*, 4*c*, 4*d*, 4*e*.

The compressor 1 according to the invention is suitable, through the low station times, the high cycle speed and the small delivery flow pulsations, for consumers which require a constant and uniform delivery flow of compressed medium, for example for the refuelling of vehicles.

Through the conveying of the operating fluid 5 into the outlet duct 7 and the conveying back of the operating fluid 5 via the separation device 8 to the inlet duct 6 of the compressor 1 and the returning of the leakage quantity of the piston machine 2 by means of the feed pump 13 to the inlet duct 6 of the compressor 1, in a simple manner a sufficient quantity of operating fluid 5 can be guaranteed in the compressor cylinders 4*a*, 4*b*, 4*c*, 4*d*, 4*e*. To control the feed pump 13, merely a simply constructed level measurement system 15 is necessary here. In addition, through the conveying of the operating fluid 5 into the outlet duct 7, dead space losses and hence conveying losses are avoided. Hereby, a high efficiency of the compressor 1 is able to be achieved.

The piston machine 2 can be operated here with a high rotation speed, whereby with a small quantity of operating fluid 5, a small structural space and low noise development, a high delivery efficiency of the compressor 1 is able to be achieved.

What we claim is:

1. A compressor for compressing a gaseous medium with at least one compressor cylinder which is connected with an inlet duct and with an outlet duct for the medium, an operating fluid being arranged in the at least one compressor cylinder, wherein the operating fluid is supplied by a displacement machine, the displacement machine being constructed as a piston machine with at least one cylinder chamber, the at least one cylinder chamber being connected with said at least one compressor cylinder, said piston machine is connected with a container by means of a leakage duct and a feed pump is connected to said container on an input side and is connected with said inlet duct of said at least one compressor cylinder on an output side, wherein a separation device for the operating fluid is associated with the outlet duct of the at least one compressor cylinder, the separation device being connected with the inlet duct of the compressor for the return of the operating fluid.

2. The compressor according to claim 1, wherein the separation device is connected with the inlet duct by means of a return duct, a valve device being arranged in the return duct.

3. The compressor according to claim 1, wherein the feed pump is controlled as a function of a quantity of operating fluid situated in the container.

4. The compressor according to claim 1, wherein the container is provided with a level measurement system, the feed pump being controlled as a function of the level measurement system.

5. The compressor according to claim 1, wherein the piston machine is constructed as a radial piston machine.

6. The compressor according to claim 1, wherein the piston machine is constructed as an axial piston machine.

7. The compressor according to claim 1, wherein operating fluid is an ionic operating fluid.

* * * * *